US007296685B2

(12) United States Patent
Malmberg

(10) Patent No.: US 7,296,685 B2
(45) Date of Patent: Nov. 20, 2007

(54) VIBRATING SCREEN FOR SCREENING CRUSHED STONE AND GRAVEL

(75) Inventor: Mats Malmberg, Rydsgard (SE)

(73) Assignee: Sandvik Intellectual Property AB, Sandviken (SE)

( * ) Notice: Subject to any disclaimer, the term of this patent is extended or adjusted under 35 U.S.C. 154(b) by 152 days.

(21) Appl. No.: 11/090,142

(22) Filed: Mar. 28, 2005

(65) Prior Publication Data

US 2005/0224397 A1 Oct. 13, 2005

(30) Foreign Application Priority Data

Mar. 26, 2004 (SE) ..... 0400789

(51) Int. Cl.
*B07B 1/49* (2006.01)

(52) U.S. Cl. ..... 209/405; 399/403; 399/408

(58) Field of Classification Search ..... 209/399, 209/403, 405, 408; 198/399
See application file for complete search history.

(56) References Cited

U.S. PATENT DOCUMENTS 5,085,324 A * 2/1992 Dehlen ..... 209/399
5,104,521 A 4/1992 Rutherford
5,248,043 A 9/1993 Dorn
5,277,319 A * 1/1994 Henry, Jr. ..... 209/399
5,346,053 A * 9/1994 Dorn ..... 198/399
5,361,911 A * 11/1994 Waites et al. ..... 209/399
5,816,413 A 10/1998 Boccabella et al.
2005/0167341 A1 * 8/2005 Bacho et al. ..... 209/405
2005/0189265 A1 9/2005 Malmberg

FOREIGN PATENT DOCUMENTS

AU 199896986 A1 6/1999

* cited by examiner

*Primary Examiner*—Patrick Mackey
*Assistant Examiner*—Terrell Matthews
(74) *Attorney, Agent, or Firm*—Drinker Biddle & Reath LLP

(57) ABSTRACT

A vibrating screen for conducting material in a longitudinal direction while screening the material comprises a screening deck, exchangeable modular screening media, and an adapter arrangement for mounting the screening media on the deck. The screening deck includes transverse carriers oriented transversely of the longitudinal direction. The adapter arrangement comprises longitudinal support carriers arranged substantially in the longitudinal direction, and connecting elements oriented transversely of the longitudinal direction for interconnecting the support carriers and connecting the interconnected support carriers on the transverse carriers.

17 Claims, 8 Drawing Sheets

110
130b
330
120
340
310
410
331
130a
320
321
322
420
391
390
a
b
c

VIBRATING SCREEN FOR SCREENING CRUSHED STONE AND GRAVEL

The present application claims priority under 35 U.S.C. §119 to Patent application Ser. No. 0400789-4 filed in Sweden on Mar. 27, 2004.

BACKGROUND OF THE INVENTION

The present invention relates to an adapter arrangement for mounting cross-tensioned or pre-tensioned screening media on a screening deck, normally provided with a special sub-frame, and to exchangeable modular screening elements for screening of material, such as crushed stone, gravel or the like.

In mining and stone industries, it is often important to fractionate crushed stone and gravel into fractions of stones with different sizes. Mostly, fractionating is done by supplying an unfractionated stream of crushed stone or gravel to a vibrating screen provided with screening elements having screening holes for allowing stones smaller than the screening holes to pass through the holes.

Today, there are vibrating screens that are manufactured to use only cross-tensioned or pre-tensioned screening media. The cross-tensioned screening media can be either wire mesh screening media or polyurethane/rubber screening media with reinforcement. The pre-tensioned screening media can either be made of a metal sheet or be made of polyurethane/rubber material in a frame with metal reinforcement. The wire mesh screening media has the advantage that it is easy to mount, cheap and has the highest percentage open area.

The cross-tensioned screening media is bought in the desired length and hooks or other fastening means are attached on the two opposite sides of the screen by simple actions. The cross-tensioned screening media is mounted in the vibrating screen with the hooks or the fastening means attached to fastenings means on the side walls of the vibrating screen.

Several support beams are arranged between the side walls of the vibrating screen having their longitudinal direction parallel to the side walls of the vibrating screen. The support beams are arranged at different heights in order to support the cross-tensioned screening media between the side walls of the vibrating screen, causing the cross-tensioned screening media to have a crowned or slightly upwardly curved shape and to support the cross-tensioned or pre-tensioned screening media when being mounted. These vibrating screens have the disadvantage that they are manufactured to only have cross-tensioned screening media, and the wire meshes are not suitable for running larger batches since they have shorter lifetime compared with vibrating screens having screening media made of polyurethane (PU) or rubber.

There are also vibrating screens having screening decks with modular screening elements, e.g. as described in SE-A-0 460 340 (corresponding to U.S. Pat. No. 5,085,324). This document shows a system with modular screening elements in a vibrating screen for screening of crushed rocks or gravel. The vibrating screen according to this document includes a multitude of screening elements. The modular screening elements and cross-tensioned polyurethane/rubber screening media are more expensive than the wire mesh screening media, but they have a longer lifetime. The modular screening elements are, however, supplied from the specific manufacture of the system of modular screening elements and therefore not as easily accessible as the cross-tensioned screening media. There are also manufacturers that deliver specific manufactured modular elements with a pre-tensioned screening media, e.g. the WS 83 module for the WS S5 modular screening system from the company Isenmann. The latter has the disadvantage of being more expensive than cross-tensioned wire mesh.

Another vibrating screen with exchangeable modular screening elements is shown in the Swedish patent application, SE0400337-2, "Screening deck".

In many cases, especially in the set-up of the vibrating screen, there is a need for running-in the screening deck of the vibrating screen in respect of the size of the screening holes. It might also be the case that a small batch of crushed stones or gravel should be fractionated with a specific size of the holes. In both cases there is a need for a quick, temporary and cheap solution. The cross-tensioned screening media is the best solution in these cases, but the present vibrating screens require to be substantially re-built before can be used with the cross-tensioned screening media if they are of the modular type. If they already are of the cross-tensioned screening media type, they have the disadvantage of not being able to use modular screening elements after the running-in period due to the construction with support beams arranged at different heights.

A difference between wire mesh and the cross-tensioned or the pre-tensioned screening media of polyurethane (PU) or rubber is that the wire mesh provides a larger open area, i.e. an area used for screening. This is caused by the fact that cross-tensioned and pre-tensioned screening media are provided with larger closed areas between the holes to get enough rigidity in the screening media, whereas the wire mesh has enough rigidity in wires forming the wire mesh and need not additional material between holes. The cross-tensioned or the pre- tensioned screening media of polyurethane (PU) or rubber needs also reinforcement material, e.g. wires, incorporated in the polyurethane (PU) or rubber to get enough rigidity.

Faced with the above prior art screening systems and the disadvantages and problems therewith, the object with the present invention is to improve the screening systems in a way that combines the advantages of the system with modular screening elements and the system with cross-tensioned screening media.

Another object of the present invention is to provide a way of providing a vibrating screen with a sub-frame for modular screening elements at the time it is provided with cross-tensioned or pre-tensioned screening media.

SUMMARY OF THE INVENTION

The above-mentioned objects are achieved by an adapter arrangement, which comprises longitudinal support carriers for supporting the cross-tensioned or pre- tensioned screening media, and connecting elements for connecting the support carriers to transverse carriers of the screening deck.

BRIEF DESCRIPTION OF THE DRAWINGS

In the following, the invention will be explained with reference to the accompanying drawings, wherein.

DESCRIPTION OF PREFERRED EMBODIMENTS

Figure 1:
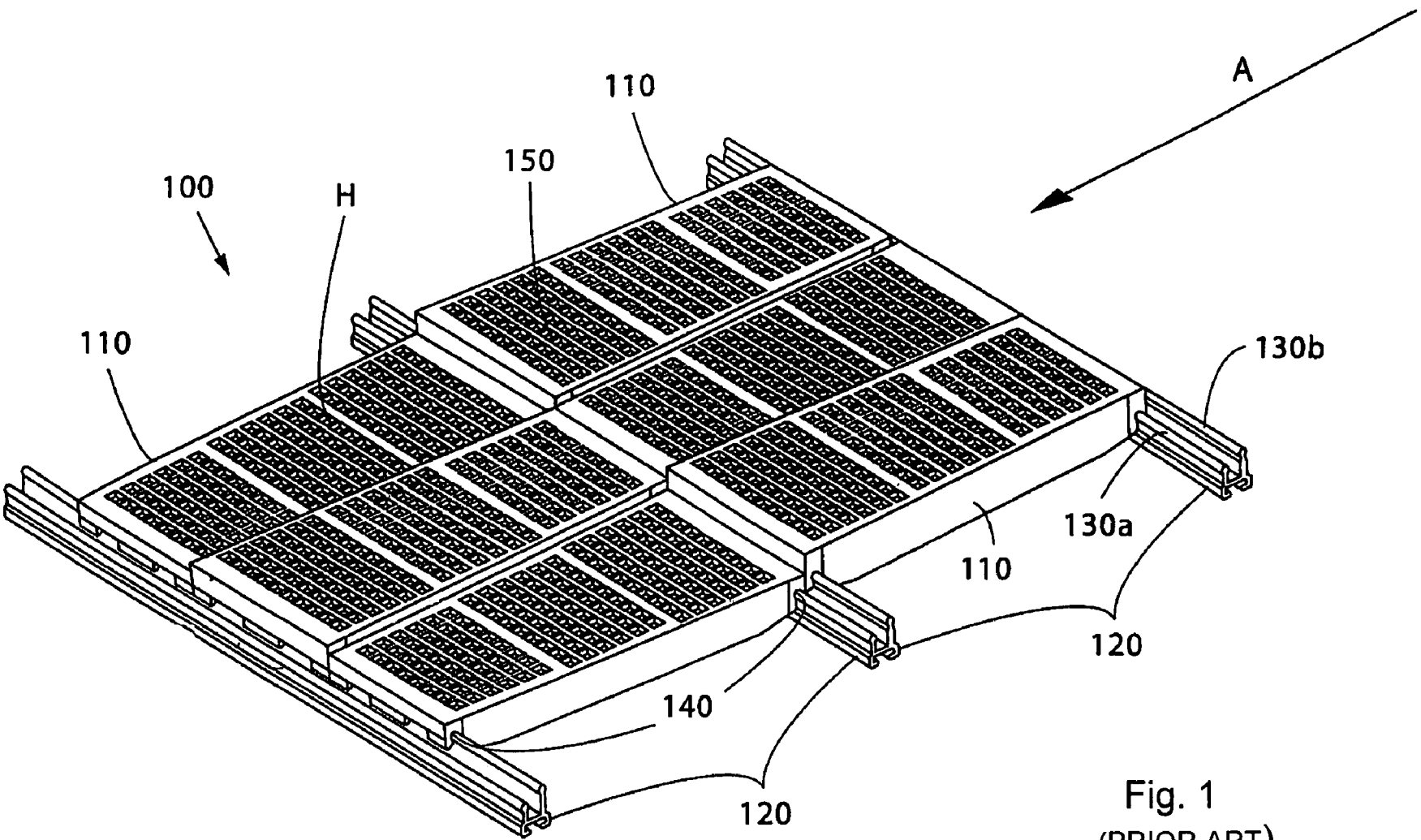
Fig. 1 (PRIOR ART)
FIG. 1 is a schematic perspective assembly view of a prior art screening deck with modular screening elements.

FIG. 1 schematically shows a prior art screening deck 100 in a vibrating screen for screening of crushed stones, gravel or the like comprising exchangeable modular screening elements 110 and transverse carriers 120. The modular screening elements 110 differ in height to improve the screening of crushed stones or gravel. The modular screening elements 110 are normally alternately placed so that the neighboring screen elements always will be at different heights. Each carrier 120 has two parallel, elongated stanchions 130*a*, 130*b*. The modular screening elements 110 have snap locks 140, which interact with the elongated stanchions 130*a*, 130*b* for fastening the screening elements to the transverse carriers 120. The transverse carriers 120 are fastened by bolting, welding or other suitable fastening means to cross members (not shown) arranged in a vibrating screen mechanism. In a surface 150 of the modular screening element 110, through-holes H have been provided for fractionating crushed stone and gravel into fractions of stones with different sizes. A longitudinal direction of the screening deck is indicated with an arrow A in FIG. 1. The longitudinal direction of the screening deck is also the travelling direction for the material, i.e. stones or gravel, on the vibrating screen.

Figure 2:
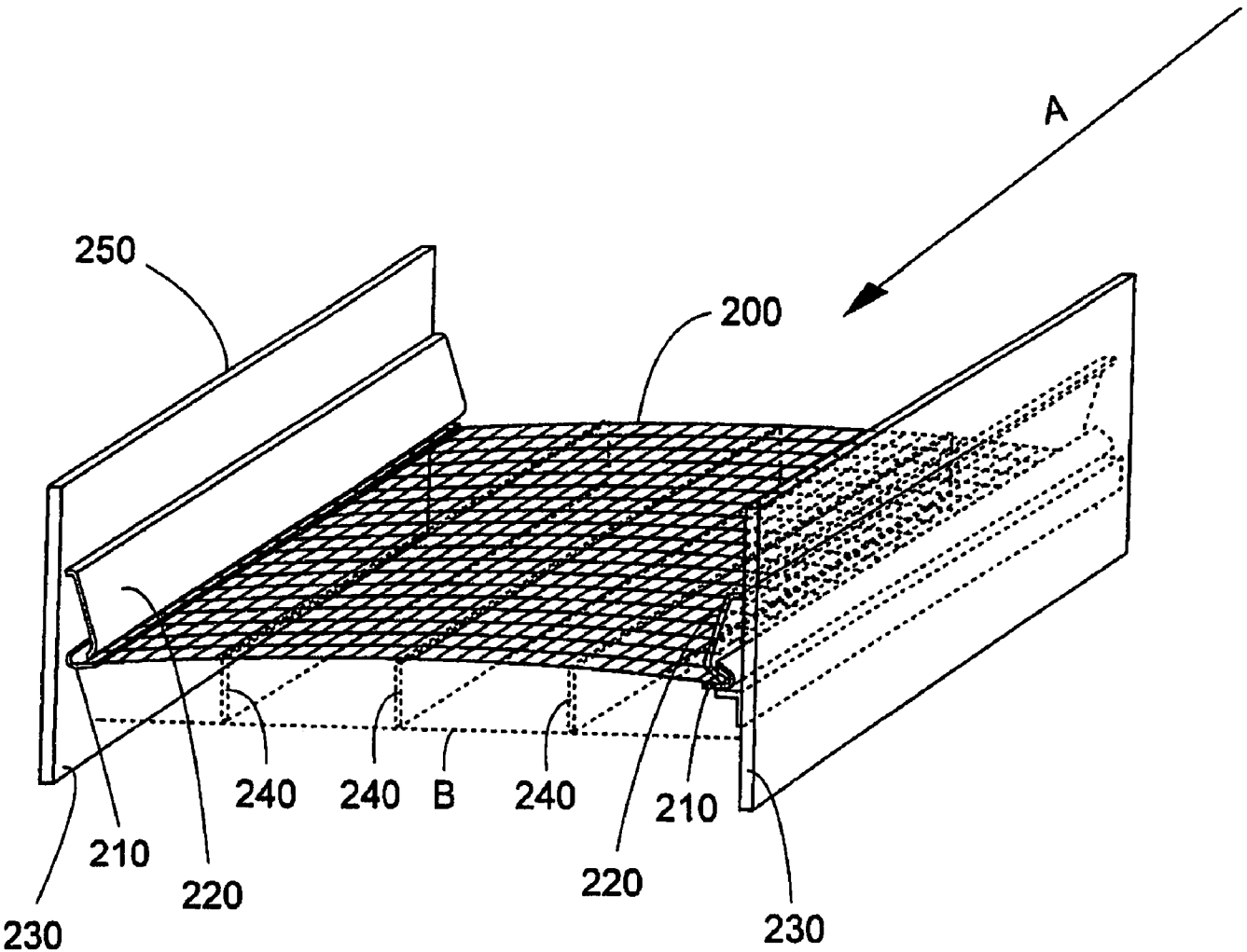
Fig. 2 (PRIOR ART)
FIG. 2 is a schematic perspective assembly view of a prior art screening deck with a cross-tensioned screening media.

FIG. 2 schematically shows a part of a prior art vibrating screen 250, where a cross-tensioned screening media 200 has been mounted. The screen 250 comprises a hook arrangement 210 in each end of the screening media 200. Fastening means 220 fasten the hook arrangements 210 to the walls 230 of the vibrating screen.

The means for fastening the screening media 200 to the vibrating screen 250 or the side walls 230 of the vibrating screen 250 can be designed in many ways, e.g. the hook arrangement shown or a screw/bolt joint etc., but is not part of the present invention. The hook arrangement is typically jammed over the edges of the screening media 200 and fixed by a bolt and nut arrangement. If pre-tensioned screening media is to be used in the vibrating screen, the fastening means 220 will only have a down- holding function, whereas the fastening means have an outwardly stretching function when using cross-tensioned screening media to form the crowned shape of the screening media.

The fastening means 220 are flexibly mounted by a bolt arrangement or similar. The fastening means 220 also have a second function in that they function as side covers in the vibrating screen protecting the vibrating screen from wear due to the material being screened. When the modular screening elements are mounted in a vibrating screen (see FIG. 7), special cover plates 820 can instead be mounted on the side walls to protect the vibrating screen from wear caused by the material being screened.

Further, supporting carriers 240 are shown in FIG. 2 that are mounted rigidly in the vibrating screen 250 to support the screening media. The supporting carriers 240 are arranged substantially parallel to the longitudinal direction A of the vibrating screen 250. The difference in height of the support carriers 240 can be seen from a virtual reference line B extending from the fastening points of the screening media 200 to the side walls of the vibrating screen 250. Due to the difference in height of the support carriers 240 the screening media 200 will form a crowned or slightly curved shape as is shown in FIG. 2.

Figure 3:
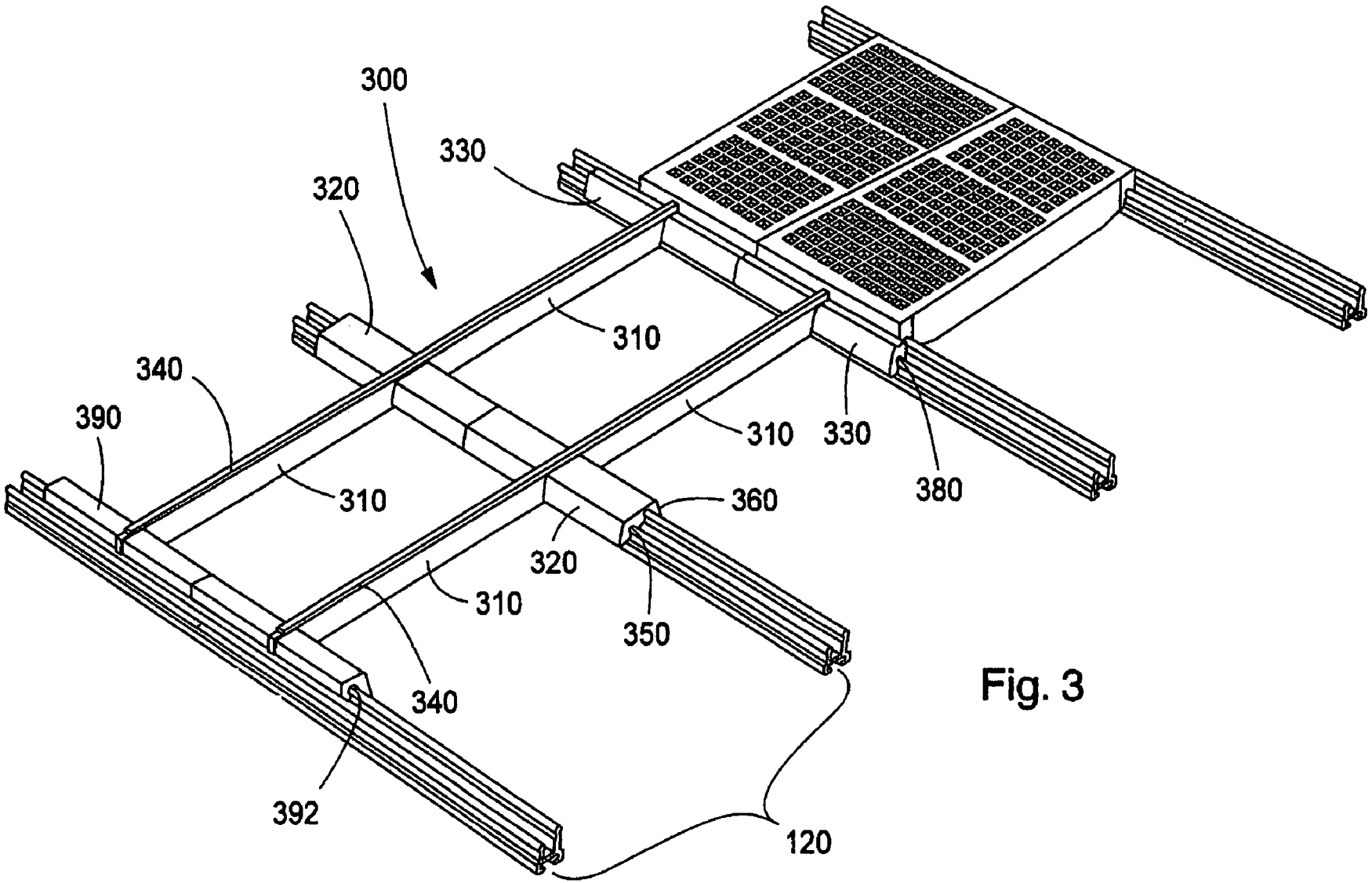
FIG. 3 is a schematic perspective assembly view of a screening deck with modular screening elements and the adapter arrangement according to the present invention.

FIG. 3 schematically shows the screening deck after two rows of modular screening elements have been removed and an adapter arrangement 300 has been mounted, in accordance with the present invention. The adapter arrangement 300 comprises longitudinal support carriers 310, first connecting elements 320, second connecting elements 330, third connecting elements 390 and cappings 340.

As is shown in FIGS. 6A-6D each of the longitudinal support carriers 310 extends between two transverse carriers 120 and is provided with snap locks 410, 420 (also shown in FIG. 5) at each end to interact with fastening means 321, 322, 331, 391 on respective first, second and third connecting elements 320, 330, 390. Each of the first, second and third connecting elements 320, 330, 390 is provided with snap locks 350, 360, 380 and 392, respectively, at its underside (FIG. 3). The snap locks interact with the elongated stanchions 130*a*, 130*b* for fastening the first, second and third connecting elements 320, 330, 390 to the transverse carriers 120.

Figure 7:
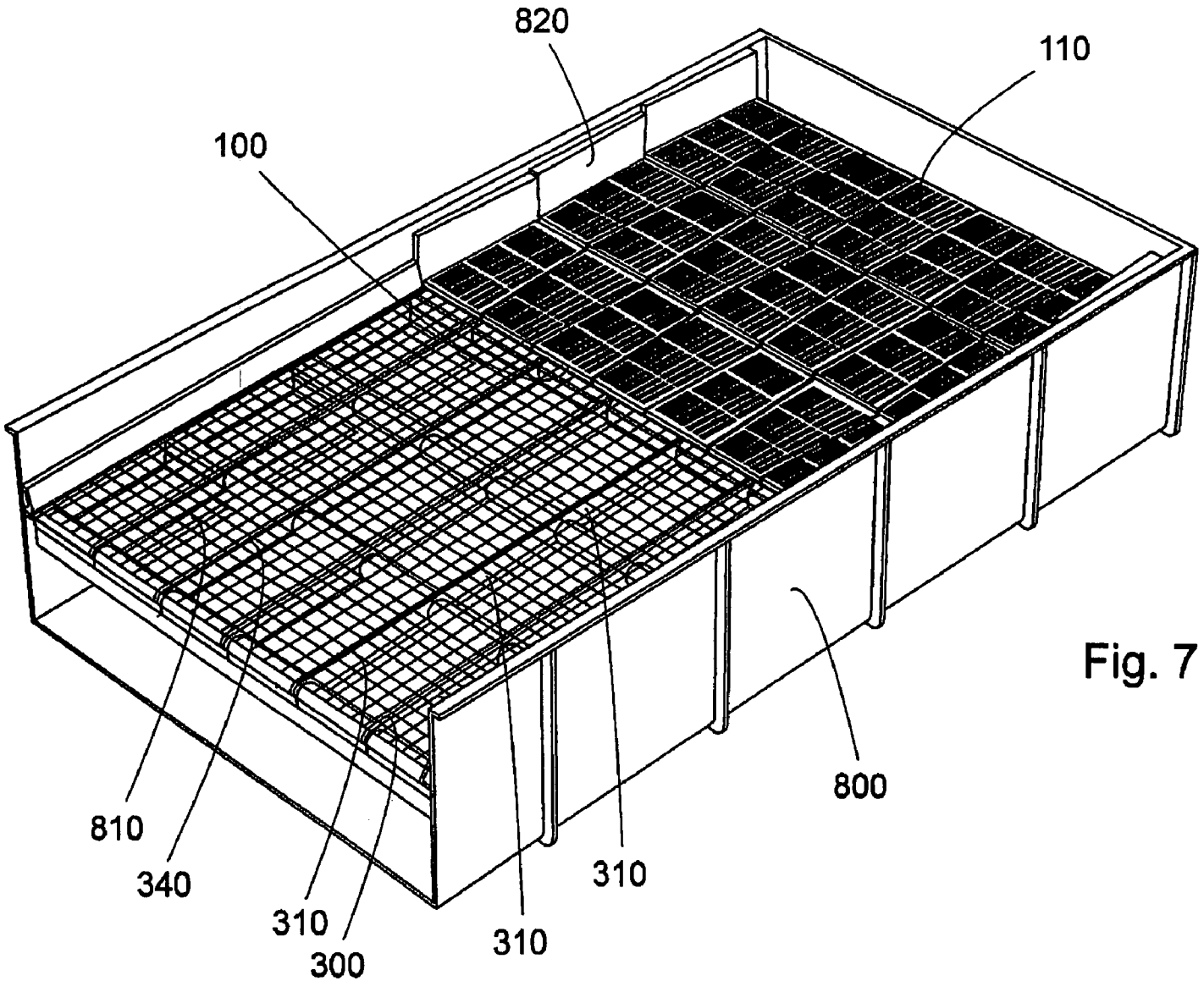
FIG. 7 is a schematic perspective assembly view of a vibrating screen having a screening deck with both modular screening elements and the cross-tensioned or pre-tensioned screening media, where the screening media has been mounted by means of an adapter arrangement according to the present invention.

The cappings 340, shown in FIG. 3, are arranged on the upper edge of the supporting carriers 310 facing the screening media and protect the support carriers 310 from wear from the screened material and also from the screening media. In FIG. 3 the cappings 340 are shown as extending over two adjacently arranged longitudinal support carriers 310 that are interconnected by a first connecting element 320, but the length of the cappings 340 can instead be equal to the length of a single support carrier 310. In FIG. 7 it is shown that the cappings 340 extend over three adjacently arranged support carriers 310.

In FIG. 3 an adapter arrangement is schematically shown, only covering a part of the length of the transverse carriers 120, but in practice the adapter arrangement 300 will be mounted along the entire length of the transverse carriers 120 (see FIG. 7) to fully function as support for the mounting of screening media on the screening deck. The cross-tensioned screening media typically extends between the side walls of the vibrating screen, a length which substantially equals the length of the transverse carriers 120.

Figures 4A, 4B, 4C:
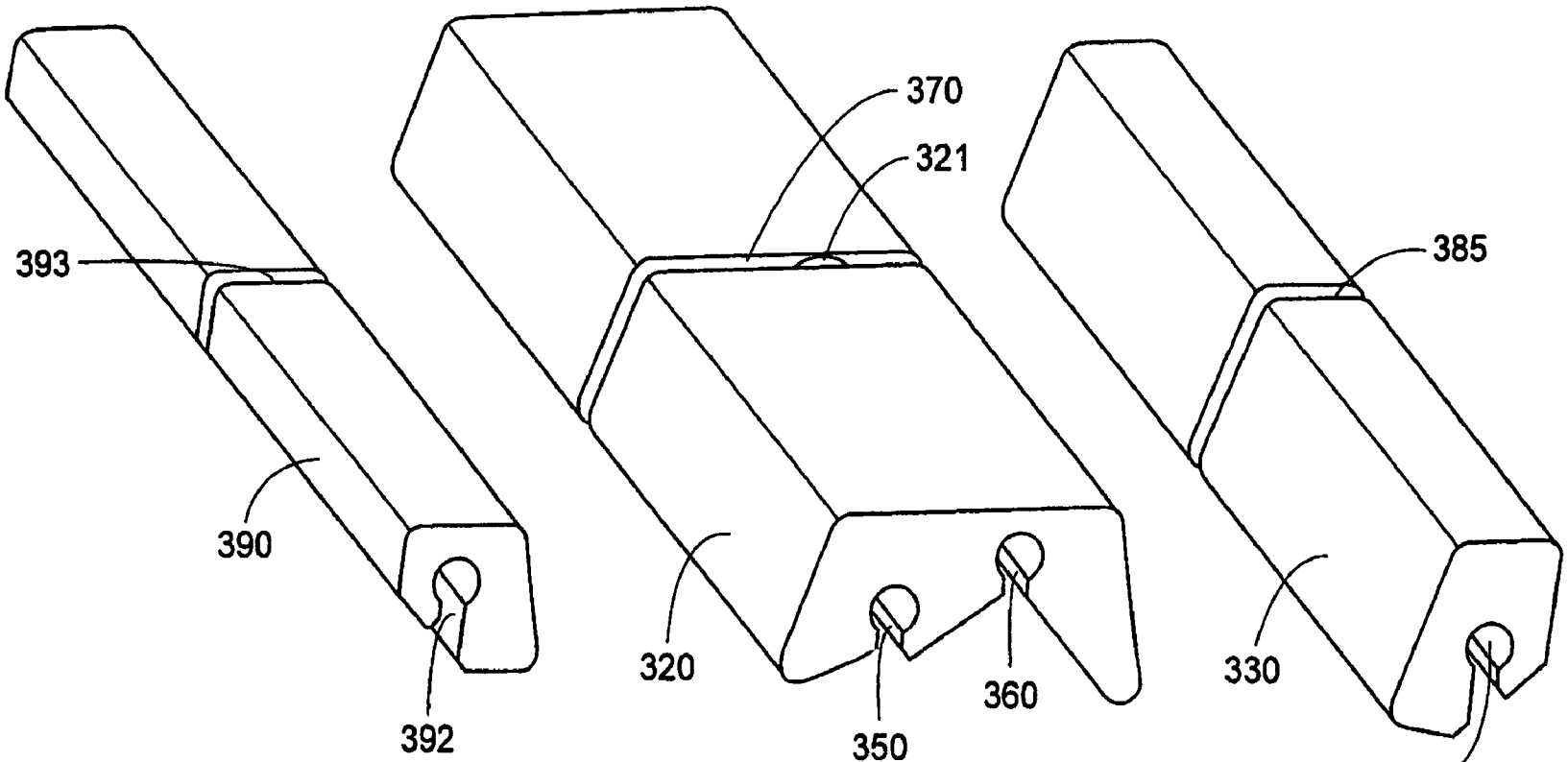
FIGS. 4A, 4B, 4C are perspective views of first, second and third adapter parts, respectively, of the adapter arrangement according to the present invention.
Figures 6, 6A, 6B, 6C, 6D:
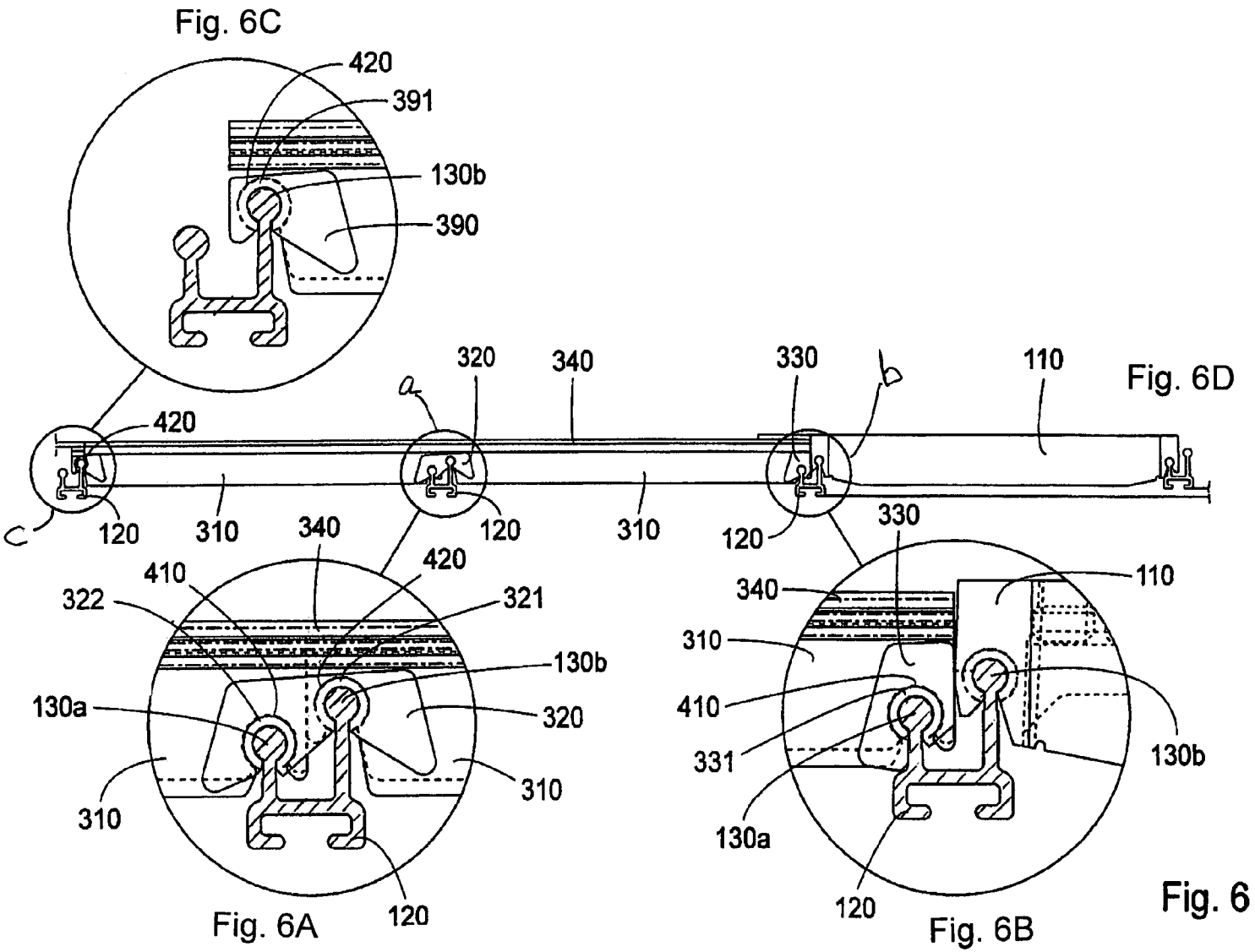
FIGS. 6A, 6B, and 6C are cross-sectional views taken at circles a, b, c, respectively in FIG. 6D, showing how first, second, and third connecting elements, respectively, are attached to transverse carriers.
FIG. 6D is a side elevational view showing a transition between screening elements according to the present invention.

FIGS. 4, 4B, 4*c* show a first set of adapter parts, the adapter parts including a first connecting element 320, a second connecting element 330, a third connecting element 390. In FIG. 4A it is shown that the first connecting element 320 further is provided with a slot 370 having fastening means 321, 322 for receiving the respective ends of two support carriers 310. The fastening means 321 is partly shown, but the fastening means 322 is concealed in FIG. 4. Both fastening means 321, 322 are shown in FIG. 6. The fastening means 321, 322 are arranged to interact with snap locks 420, 410, respectively, of the support carriers 310. In FIG. 4 is also shown that the snap locks 350, 360 are arranged to adapt to the difference in height between the stanchions 130*a*, 130*b*.

In FIG. 4B, it is shown that also the second connecting element 330 is provided with a slot 385 having fastening means 331 (concealed in FIG. 4, but shown in FIG. 6) for receiving the snap lock 410 arranged at the end of the support carriers 310. The second connecting element 330 is also provided with a snap lock 380 at its underside. The snap lock 380 interacts with the shorter, elongated stanchion 130*a* on the transverse carrier 120 for fastening the second connecting elements 330 to the transverse carrier 120. The second connecting element 330 is typically used as an end element of the adapter arrangement, adjacent to modular elements 110 (see FIGS. 3 and 6).

In FIG. 4C the third connecting element 390 is shown as provided with a slot 393 having fastening means 391 (concealed in FIG. 4, but shown in FIG. 6) for receiving the snap lock 420 arranged at the end of the support carriers 310. The third connecting element 390 is also provided with a snap lock 392 at its underside. The snap lock 392 interacts with the longer, elongated stanchion 130*b* on the transverse carrier 120 for fastening the third connecting element 390 to the transverse carrier 120. The third connecting element 390 is typically used as an end element of the adapter arrangement, adjacent to the end of the screen (see FIGS. 4 and 6).

As an alternative to the configuration to the first set of adapter parts shown in FIG. 4, a second set of adapter parts can be used, adapted to transverse carriers having stanchions of equal height. This alternative configuration of the first, second and third connecting element would otherwise have the same functional structure as the earlier described first, second and third connecting elements 320, 330, 390.

Figure 5:
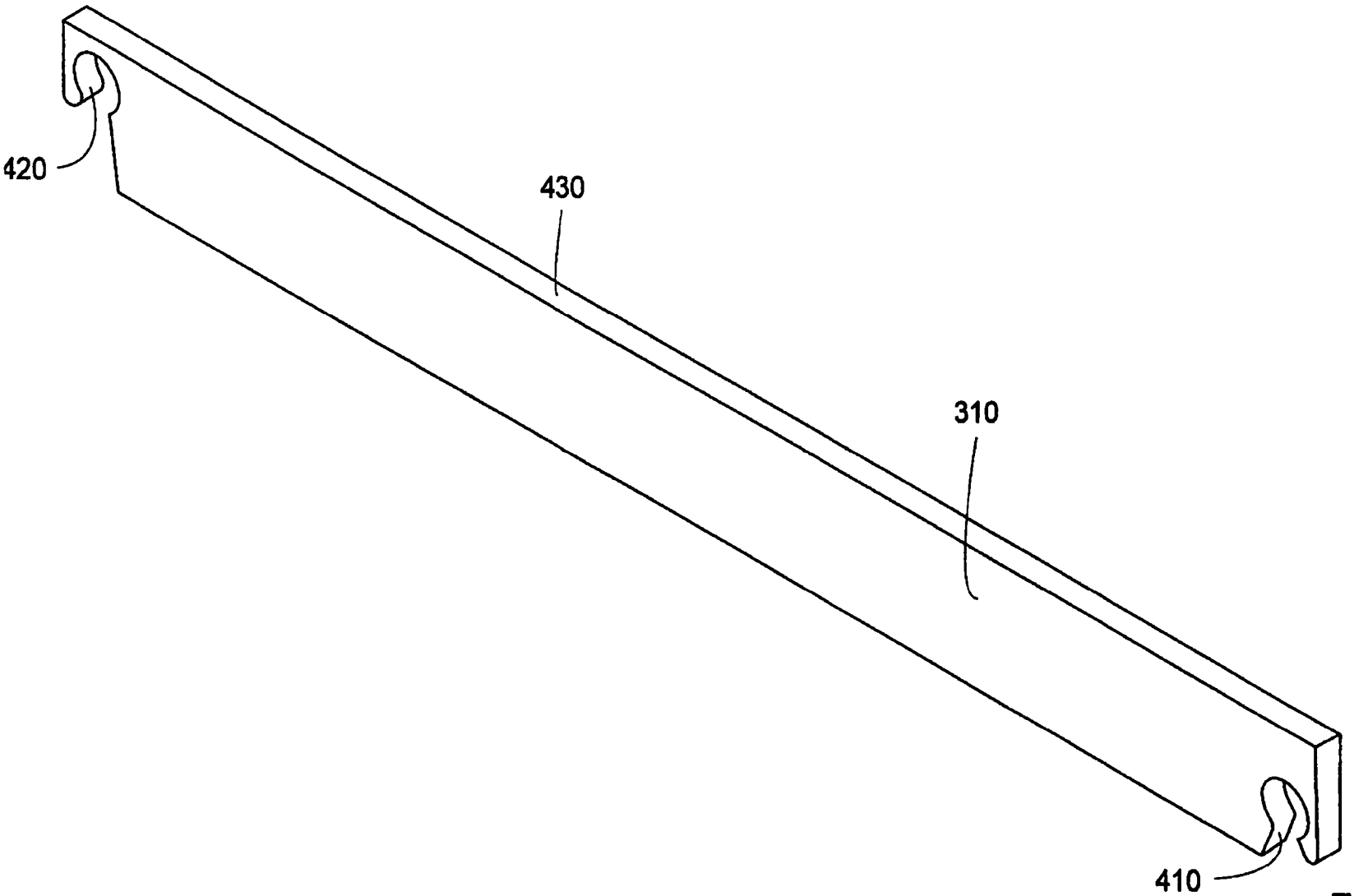
FIG. 5 is a perspective view of a support carrier in the adapter arrangement according to the present invention.

In FIG. 5 a support carrier 310 is shown having two snap locks 410, 420 provided at its two ends. The support carrier 310 has an upper edge or side 430, where a capping 340 (shown in FIG. 3) would be mounted to protect the support carrier 310 from the screened material and the screening media. The support carrier 310 is further configured: (i) so that the snap lock 410 interacts with the fastening means 331 of the second connecting element 330 or the second fastening means 322 on the first connecting element 320, and (ii) so that the snap lock 420 interacts with the fastening means 391 of the third connecting element 390 or the first fastening means 321 on the first connecting element 320.

The longitudinal support carriers 310 preferably have different heights to support the screening media in a manner forming the crowned or slightly upwardly curved shape, when mounted. Typically the support carriers 310 arranged closest to the side walls of the vibrating screen will be lower in height than the support carriers arranged halfway between the side walls to create the slightly upwardly curved shape of the cross-section of the screening media. The support carriers 310 also serve to support the screening media, when it is mounted.

As an alternative to having longitudinal support carriers 310 of different heights to create the slightly upwardly curved shape of the cross-section of the screening media, all support carriers 310 could have the same height and the cappings 340 could be of different respective heights to create the same effect. Cappings of different heights will be further discussed in connection with a vibrating screen having longitudinal carriers to hold modular screening elements, where the longitudinal support carriers 310 and the adapter parts are not needed.

FIGS. 6A-6C show respective cross sections of the adapter arrangement 300 mounted on transverse carriers 120. The adapter arrangement 300 comprises: (i) two of the support carriers 310 joined together by a first connecting element 320, (ii) a second connecting element 330 to which one end of the support carriers 310 has been fastened, (iii) a third connecting element to which an opposite end of the support carriers 310 has been fastened, and (iv) a capping 340 mounted on top of the two support carriers. In FIGS. 6A, 6B and 6C it is shown how the respective first, second and third connecting elements 320, 330, 390 are attached to the transverse carriers 120 and how the support carriers 310 are attached to the first, second and third connecting elements 320, 330, 390. Further FIG. 6D shows the transition between screening elements 110 and the adapter arrangement 300 for the screening media.

In FIG. 7 a screening deck 100 of a vibrating screen 800 according to the invention is shown schematically, after three rows of modular screening elements 110 have been removed and a cross-tensioned screening media 810 has been mounted on top of the adapter arrangement 300. Even though only one screening media 810 is shown in FIG. 7 covering three rows, it is possible to use several screening media with possibly different hole sizes or different configuration of the holes extending between the side walls that are mutually parallel to and successively arranged in the longitudinal direction of the vibrating screen 800.

Figure 8:
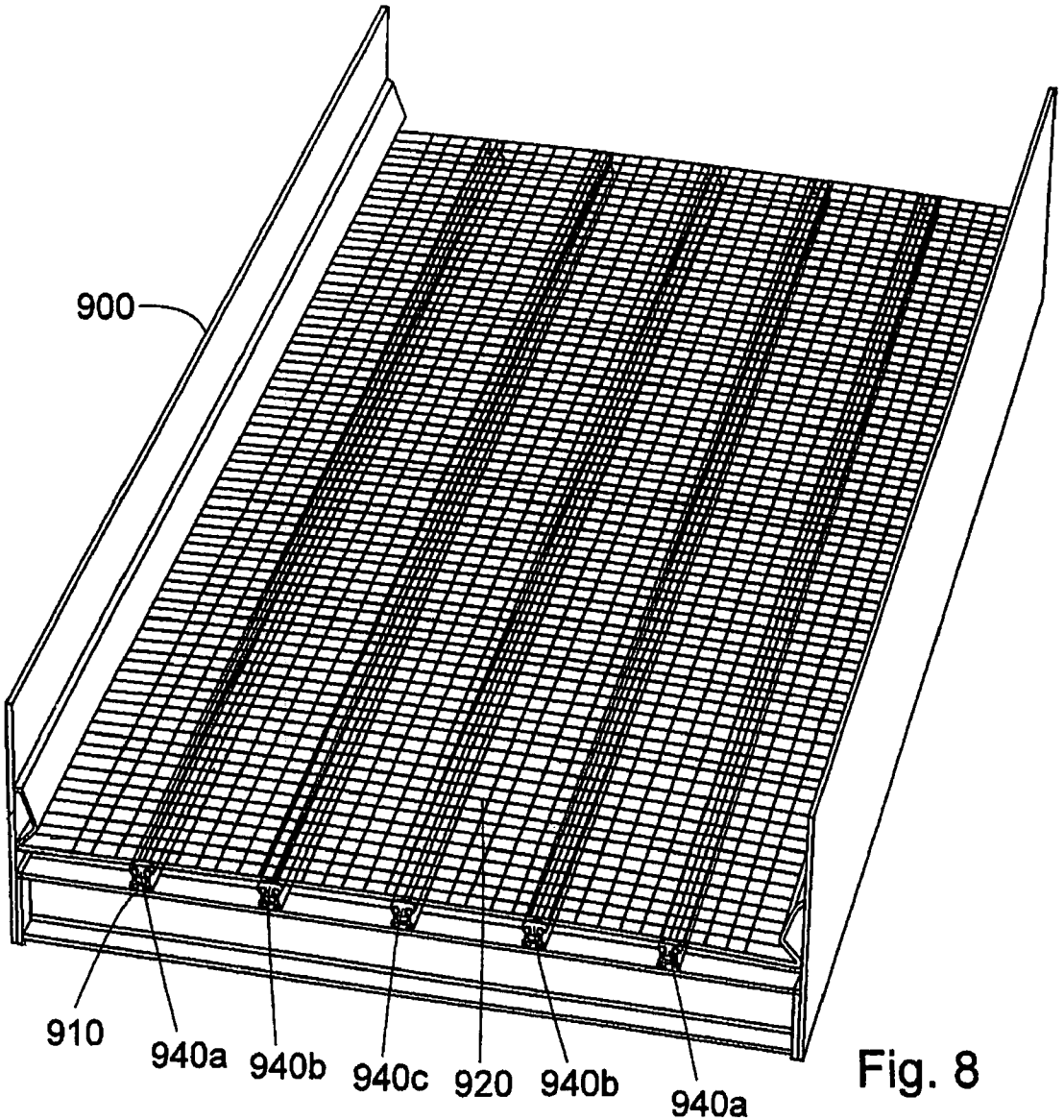
FIG. 8 is a schematic perspective assembly view of a screening deck with longitudinal carriers for holding modular screening elements, where a cross-tensioned or pre-tensioned screening media have been mounted by means of an adapter arrangement according to the present invention.

In FIG. 8 a screening deck 900 is shown after modular screening elements 110 have been replaced by a cross-tensioned screening media 920 (i.e., the vibrating screen combines different types of screens). On the top edge of longitudinal carriers 910, cappings 940*a*, 940*b*, 940*c* are arranged facing a cross-tensioned screening media 920 and protecting the support carriers 900 from wear from the screened material and also from the cross-tensioned screening media 920. Similar to the transversal carriers 120, the longitudinal carriers 910 are provided with two parallel, elongated stanchions. The stanchions have the same height. The modular screening elements 110 have snap locks 140, which interact with the elongated stanchions for fastening the modular screening elements 110 to the longitudinal carriers 910. The cappings 940*a*, 940*b*, 940*c* are provided with similar snap locks, which interact with the elongated stanchions for fastening the cappings 940*a* to the longitudinal carriers. To form the crowned or the slightly curved shape of the screening media and support the cross-tensioned screening media 920, the cappings 940*a* have different heights. The screening media 920, which also can be a pre-tensioned screening media, is fastened by any previously disclosed fastening method.

When the vibrating screens are very wide, there would be provided an additional holding-down or fixing point with down holding means for holding down the middle of the cross-tensioned screening media so that the crowned shape is not so high as to cause the material being screened to deviate to the sides and producing poor screening results. Thereby two crowned shapes are arranged with the cross-tensioned screening media over the width of the vibrating screen.

It is an advantage if modular screening elements and one or several screening media can be provided in the same vibrating screen as shown in FIG. 7, since the two solutions complement each other. Modular screening elements are very good since they have a long lifetime, and wire meshes are very good for screening the gravel into the right fractions of gravel. It is therefore an advantage that both types can be combined in the same vibrating screen by simple actions.

The present invention is implemented in a vibrating screen of the type shown in the Swedish patent application, SE0400337-2, but could of course be modified to function with other vibrating systems having exchangeable modular screening elements without deviating from the scope of the invention.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A vibrating screen for conducting material in a longitudinal direction while screening the material, the vibrating screen comprising a screening deck, exchangeable modular screening media, and an adapter arrangement for mounting the screening media on the deck, the screening deck including transverse carriers oriented transversely of the longitudinal direction, the adapter arrangement comprising longitudinal support carriers arranged substantially in the longitudinal direction, and connecting elements oriented transversely of the longitudinal direction interconnecting the support carriers and connecting the interconnected support carriers on the transverse carriers.

2. The vibrating screen according to claim 1 wherein the support carriers extend to different respective heights.

3. The vibrating screen according to claim 1 wherein the screening media is crown-shaped such that portions of the screening media spaced apart transversely of the longitudinal direction extend to different respective heights.

4. The vibrating screen according to claim 3 wherein the support carriers include support carriers extending to different heights to form the crown shape.

5. The vibrating screen according to claim 1 wherein longitudinally adjacent screening media extend to different respective heights.

6. The vibrating screen according to claim 5 wherein longitudinally adjacent ones of the longitudinal support carriers extend to different respective heights.

7. The vibrating screen according to claim 1 further including capping mounted on upper edges of the longitudinal support carriers and covering the entire longitudinal length of the longitudinal edges.

8. The vibrating screen according to claim 7 wherein the capping extend to different respective heights.

9. The vibrating screen according to claim 8 wherein longitudinally adjacent capping extend to different respective heights to support longitudinally adjacent screening media at different respective heights.

10. The vibrating screen according to claim 1 wherein each of at least some of the transverse carriers includes fastening elements projecting upwardly to different respective heights, the connecting elements being mounted on the fastening elements.

11. The vibrating screen according to claim 1 wherein each of at least some of the transverse carriers includes fastening elements projecting upwardly to the same height, the connecting element being mounted on the fastening elements.

12. The vibrating screen according to claim 1 wherein the transverse carriers include upwardly projecting stanchions, and the connecting elements include snap locks engageable with the stanchions.

13. The vibrating screen according to claim 1 wherein each of the longitudinal support carriers includes snap locks at respective longitudinal ends thereof, ad the transverse carriers include upstanding stanchions to which the snap locks are connected.

14. The vibrating screen according to claim 2 further including a capping mounted on upper edges of the longitudinal support carriers and covering the entire length thereof.

15. The vibrating screen according to claim 1 wherein the screening media comprises cross-tensioned screening media.

16. The vibrating screen according to claim 1 wherein the screening media comprises pre-tensioned screening media.

17. A vibrating screen for conducting material in a longitudinal direction while screening the material, the vibrating screen comprising a screening deck, exchangeable modular screening media, and an adapter arrangement mounting the screening media on the deck, the adapter arrangement comprising longitudinal support carriers arranged substantially in the longitudinal direction, and capping mounted on upper edges of the longitudinal support carriers on which the screening media rests.

* * * * *